US011746993B1

(12) United States Patent
Kumar et al.

(10) Patent No.: US 11,746,993 B1
(45) Date of Patent: Sep. 5, 2023

(54) IEC ZONE 1 RATED LED LIGHT ENGINE USING PRE-MOLDED ENCAPSULATION LAYER AND METAL SHEET

(71) Applicant: Appleton Grp LLC, Rosemont, IL (US)

(72) Inventors: Sumit Kumar, Pune (IN); Jean-Francois Monteil, Signy l'Abbaye (FR); Timothy E. Graff, Arlington Heigtits, IL (US)

(73) Assignee: Appleton Grp LLC, Rosemont, IL (US)

( * ) Notice: Subject to any disclaimer, the term of this patent is extended or adjusted under 35 U.S.C. 154(b) by 0 days.

(21) Appl. No.: 17/845,257

(22) Filed: Jun. 21, 2022

(30) Foreign Application Priority Data

May 16, 2022 (FR) ..... 2204613

(51) Int. Cl.
*F21V 19/00* (2006.01)
*F21V 5/00* (2018.01)
(Continued)

(52) U.S. Cl.
CPC ..... *F21V 19/002* (2013.01); *F21V 5/007* (2013.01); *F21V 29/773* (2015.01); *F21Y 2105/10* (2016.08); *F21Y 2115/10* (2016.08)

(58) Field of Classification Search
CPC ..... F21Y 2105/00; F21Y 2105/10; F21Y 2105/012; F21Y 2105/14; F21Y 2105/16;
(Continued)

(56) References Cited

U.S. PATENT DOCUMENTS 8,899,786 B1 * 12/2014 Moghal ..... F21K 9/60 362/249.02
2004/0246452 A1 12/2004 Fujisawa et al.
(Continued)

FOREIGN PATENT DOCUMENTS

CN 206268916 U 6/2017
EP 2701215 B1 1/2018
(Continued)

OTHER PUBLICATIONS

PCT International Search Report and Written Opinion, Application No. PCT/IB2022/051912, dated Jun. 17, 2022, 9 pages.
(Continued)

*Primary Examiner* — Erin Kryukova
(74) *Attorney, Agent, or Firm* — McDonnell Boehnen Hulbert & Berghoff LLP

(57) ABSTRACT

An encapsulated LED engine including a circuit board, one or more of LED arrays, each of the one or more LED arrays mounted on the circuit board, a pre-molded encapsulation layer positioned over and adhered to the circuit board, a frame positioned over the one or more LED arrays and secured to the circuit board, a metal sheet positioned between the pre-molded encapsulation layer and the frame, wherein the pre-molded encapsulation layer includes a plurality of lenses positioned over a plurality of LEDs on each of the one or more LED arrays, and wherein the metal sheet includes a plurality of apertures through which the plurality of lenses on the pre-molded encapsulation layer extend through.

20 Claims, 7 Drawing Sheets

(51) Int. Cl.
*F21V 29/77* (2015.01)
*F21Y 105/10* (2016.01)
*F21Y 115/10* (2016.01)

(58) Field of Classification Search
CPC ..... F21V 15/01; F21V 5/007; F21V 25/12; F21V 31/005; F21V 19/002; F21V 19/0015; F21V 19/003; F21V 19/0035; F21V 19/0005
See application file for complete search history.

(56) References Cited

U.S. PATENT DOCUMENTS

2008/0298060 A1 12/2008 Ohkawa
2010/0271708 A1* 10/2010 Wilcox ..... G02B 19/0061 359/654
2011/0103051 A1* 5/2011 Wilcox ..... F21V 25/12 362/267
2011/0310600 A1 12/2011 Lehman et al.
2012/0087118 A1* 4/2012 Bailey ..... F21V 15/015 362/373
2012/0300456 A1* 11/2012 Phillips, III ..... F21V 5/04 362/245
2013/0021797 A1 1/2013 Kubo
2018/0073706 A1 3/2018 Palfreyman et al.
2020/0028037 A1 1/2020 Kumar et al.
2020/0029403 A1* 1/2020 Chaturvedi ..... H01L 25/0753
2022/0221133 A1* 7/2022 Dachlan ..... F21V 29/70

FOREIGN PATENT DOCUMENTS

EP 3 460 323 A1 3/2019
KR 10-1684302 B1 12/2016
WO 2020016679 A1 1/2020

OTHER PUBLICATIONS

Pending U.S. Appl. No. 17/686,937, filed Mar. 4, 2022.
Information Disclosure Statement filed on Mar. 9, 2022 in Pending U.S. Appl. No. 17/686,937.
Search Report issued in corresponding French Patent Application No. 2204613, dated Dec. 12, 2022, 19 pages.

* cited by examiner

IEC ZONE 1 RATED LED LIGHT ENGINE USING PRE-MOLDED ENCAPSULATION LAYER AND METAL SHEET

RELATED APPLICATIONS

This application claims priority French Patent Application No. 2204613 filed May 16, 2022, entitled "IEC ZONE 1 Rated LED Light Engine using Pre-Molded Encapsulation Layer and Metal Sheet", the entire contents of which are incorporated by reference herein.

FIELD

The present disclosure relates to the field of luminaires. More particularly, the present disclosure relates to the field of LED engines used in luminaires useful for use in hazardous environments.

DEFINITIONS

As used in the present disclosure, the following terms are generally intended to have the meaning as set forth below, except to the extent that the context in which they are used indicates otherwise.

The term "LED engine" used hereinafter in this specification refers to, but is not limited to, an integrated assembly comprising one or more LED arrays positioned on a circuit board, and an encapsulation layer positioned over the one or more LED arrays, where the one or more LED arrays may be connected to an LED driver. More specifically, an LED engine includes LEDs mounted on a circuit board that have electrical connections that are ready to be fixed to an LED driver in an LED luminaire.

The term "Zone-1" used hereinafter in this specification refers to the IEC standard defining Zone-1 at the time of filing this application. The term IEC stands for the International Electrotechnical Commission, an organization that prepares and publishes international standards for all electrical, electronic and related technologies. Zone-1 generally refers to an area in which an explosive atmosphere is likely to occur occasionally in normal operation. It may exist because of repair, maintenance operations, or leakage.

The term "Zone-2" used hereinafter in this specification refers to the IEC standard defining Zone-2 at the time of filing this application. Zone-2 generally refers to an area in which an explosive atmosphere is not likely to occur in normal operation but, if it does occur, will persist for a short period only. These areas become hazardous only in an event of an accident or some unusual operating condition.

BACKGROUND

The background information herein below relates to the present disclosure but is not necessarily prior art.

LED luminaires are widely used in industrial environments. However, in industrial environments, where an explosive atmosphere persists between 10 and 1000 hours a year due to the nature of the products being manufactured or processed, the electrical discharges are required to be tightly controlled in order to prevent explosions. It is mandatory to ensure that the electrical products used in such explosive atmospheres should eliminate the potential for electrical discharges such as sparks or arcs.

Conventionally, the lighting fixtures, which are used in Zone-1 applications, are flame proof fixtures. These flame proof fixtures are usually heavy and bulky which is not desired. Further, completely encapsulated LED engines were introduced, as an alternative to conventional flame proof structures and other known conventional techniques, for preventing electrical discharges considering the complexity and difficulty involved with other known conventional techniques. However, in order to fulfill the requirement of the desired lumen output, multiple LED arrays are needed in a single LED engine of an LED luminaire, thereby increasing the number of interconnections required and the quantity of wires joined to light up the LED arrays.

The increased number of interconnections and wiring also shrinks the reliability of the conventional encapsulated LED engine. Further, various protection methods are known in the art to make the LED luminaire compatible for hazardous industrial environments. However, such methods lower the efficacy and adversely affect the beam pattern generated by LED arrays. Further, such conventional methods are costly.

Therefore, there is felt a need of an encapsulated LED engine that alleviates the abovementioned drawbacks and is compatible for use in hazardous industrial environments, such as Zone-1 and Zone-2.

SUMMARY

The present disclosure is directed to an encapsulated LED engine. The LED engine comprises a circuit board, one or more LED arrays, a pre-molded encapsulation layer, and a frame secured to the circuit board over the one or more LED arrays and the pre-molded encapsulation layer. The LED engine also may include a metal sheet positioned between the frame and the pre-molded encapsulation layer. Each of the one or more LED arrays is mounted on the circuit board, and may be electrically connected to each other. Each of the LED arrays includes a plurality of LEDs electrically connected to each other.

The pre-molded encapsulation layer is configured to encapsulate each of the LED arrays and the electrical connections therebetween. The pre-molded encapsulation layer is a pre-molded optic having a plurality of lenses that may be secured to the circuit board with an adhesive. The pre-molded encapsulation layer is sandwiched between a frame and the printed circuit board. The frame is secured to the circuit board using fasteners. The encapsulated LED engine is compatible for use in hazardous industrial environments, such as Zone-1 and Zone-2

In one aspect, an encapsulated LED engine is provided including a circuit board, one or more of LED arrays, each of the one or more LED arrays mounted on the circuit board, a pre-molded encapsulation layer positioned over and adhered to the circuit board, a frame positioned over the one or more LED arrays and secured to the circuit board, a metal sheet positioned between the pre-molded encapsulation layer and the frame, wherein the pre-molded encapsulation layer includes a plurality of lenses positioned over a plurality of LEDs on each of the one or more LED arrays, and wherein the metal sheet includes a plurality of apertures through which the plurality of lenses on the pre-molded encapsulation layer extend through.

In another aspect, a method of forming an encapsulated LED engine is provided. The method includes the steps of (i) providing a circuit board, one or more of LED arrays, each of the one or more LED arrays mounted on the circuit board, a pre-molded encapsulation layer positionable over and adherable to the circuit board, a frame positionable over the one or more LED arrays and securable to the circuit board, a metal sheet positionable between the pre-molded encapsulation layer and the frame, wherein the pre-molded encapsulation layer includes a plurality of lenses positionable over a plurality of LEDs on each of the one or more LED arrays, and wherein the metal sheet includes a plurality of apertures through which the plurality of lenses on the pre-molded encapsulation layer are extendable through; (ii) adhering the pre-molded encapsulation onto the circuit board over the plurality of LEDs positioned on the one or more LED arrays mounted on the circuit board; (iii) positioning the metal sheet over the pre-molded encapsulation layer such that the lenses extend at least partially through the apertures on the metal sheet; and (iv) securing the frame to the circuit board over the metal sheet and the pre-molded encapsulation layer.

Objects

Some of the objects of the present disclosure, which at least one embodiment herein satisfies, are as follows:

An object of the present disclosure is to provide an encapsulated LED engine and a process of making the encapsulated LED engine that are cost effective.

Still another object of the present disclosure is to provide an encapsulated LED engine which has reduced surface temperature.

Yet another object of the present disclosure is to provide an encapsulated LED engine which has a simple configuration.

Still another object of the present disclosure is to provide an encapsulated LED engine which has improved life.

Yet another object of the present disclosure is to provide an encapsulated LED engine that is not prone to early de-lamination due to frequent exposure to thermal shocks.

Still another object of the present disclosure is to provide an encapsulated LED engine that eliminates the requirement of secondary optics.

Yet another object of the present disclosure is to provide an encapsulated LED engine that is modular.

Yet another embodiment of the present disclosure is to provide an encapsulated LED engine that eliminates formation of air bubbles.

Yet another object of the present disclosure is to provide a process for encapsulating an LED engine that does not affect the beam pattern of the LED arrays.

Other objects and advantages of the present disclosure will be more apparent from the following description, which is not intended to limit the scope of the present disclosure.

BRIEF DESCRIPTION OF THE FIGURES

The present disclosure is directed to an encapsulated LED engine.

DETAILED DESCRIPTION

Embodiments, of the present disclosure, will now be described with reference to the accompanying drawings.

Embodiments are provided so as to thoroughly and fully convey the scope of the present disclosure to the person skilled in the art. Numerous details, are set forth, relating to specific components, and methods, to provide a complete understanding of embodiments of the present disclosure. It will be apparent to the person skilled in the art that the details provided in the embodiments should not be construed to limit the scope of the present disclosure. In some embodiments, well-known processes, well-known apparatus structures, and well-known techniques are not described in detail.

The terminology used, in the present disclosure, is only for the purpose of explaining a particular embodiment and such terminology shall not be considered to limit the scope of the present disclosure. As used in the present disclosure, the forms "a," "an," and "the" may be intended to include the plural forms as well, unless the context clearly suggests otherwise. The terms "comprises," "comprising," "including," and "having," are open ended transitional phrases and therefore specify the presence of stated features, integers, steps, operations, elements, modules, units and/or components, but do not forbid the presence or addition of one or more other features, integers, steps, operations, elements, components, and/or groups thereof. The particular order of steps disclosed in the method and process of the present disclosure is not to be construed as necessarily requiring their performance as described or illustrated. It is also to be understood that additional or alternative steps may be employed.

When an element is referred to as being "mounted on," "engaged to," "connected to," or "coupled to" another element, it may be directly or indirectly on, engaged, connected or coupled to the other element. As used herein, the term "and/or" includes any and all combinations of one or more of the associated listed elements.

The terms first, second, third, etc., should not be construed to limit the scope of the present disclosure as the aforementioned terms may be only used to distinguish one element, component, region, layer or section from another component, region, layer or section. Terms such as first, second, third etc., when used herein do not imply a specific sequence or order unless clearly suggested by the present disclosure.

Terms such as "inner," "outer," "beneath," "below," "lower," "above," "over," and the like, may be used in the present disclosure to describe relationships between different elements as depicted in the Figures.

The present disclosure is directed to an encapsulated LED engine.

Figure 1:
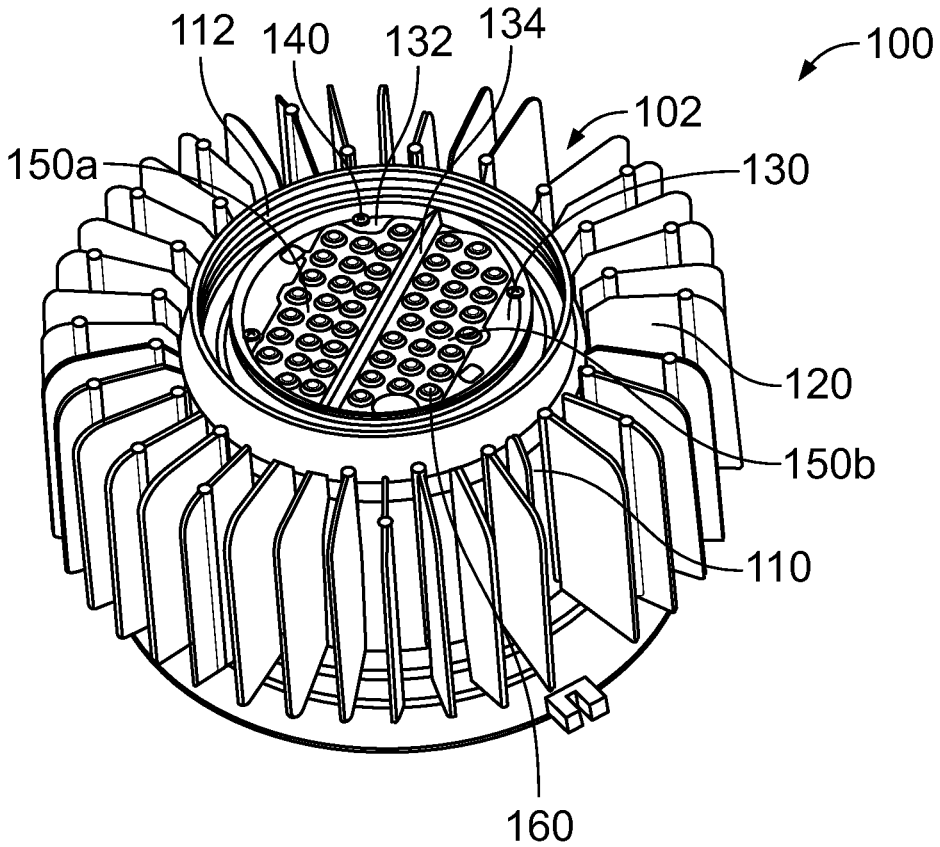
FIG. 1 illustrates a perspective view of LED luminaire 100, in accordance with an embodiment of the present disclosure.
Figure 2:
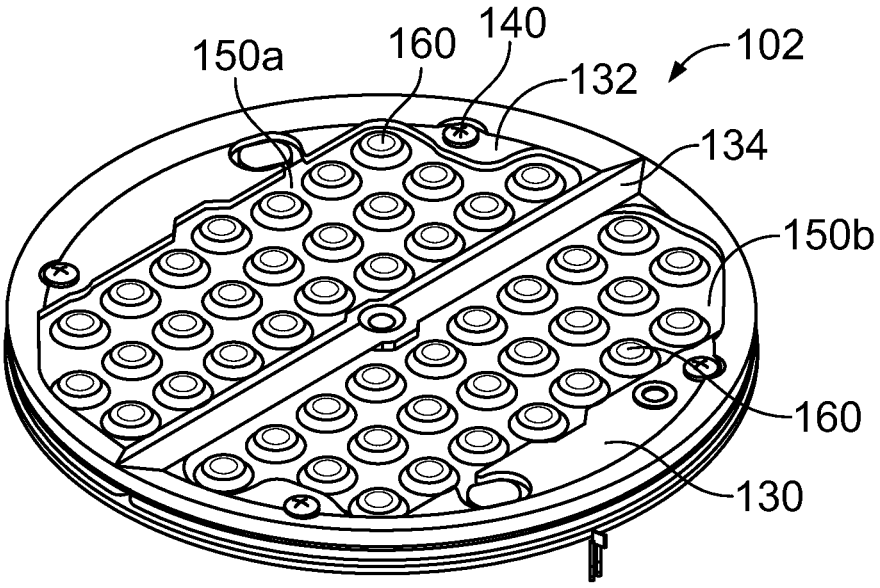
FIG. 2 shows a perspective view of the LED engine 102 of LED luminaire 100 shown in FIG. 1.

FIG. 1 illustrates a perspective view of LED luminaire 100, and FIG. 2 shows a perspective view of LED engine 102 of LED luminaire 100. LED engine 102 is positioned centrally within the LED luminaire 100. A plurality of fins 120 extend from housing 110 of LED luminaire 100. Housing 110 includes internal threads 112 for attachment to frame 130 of LED engine 100 and to LED luminaire support. External threads may also be used to attach the housing 110 to an LED luminaire support. A frame 130 with cross beam 134 is positioned over metal sheet portions 150*a* and 150*b* and lenses 160 (shown here as raised bubbles) that extend through apertures 152 of metal sheet portions 150*a* and 150*b*. Fasteners 140, which may be threaded screws, extend through frame flange 132 of frame 130 and are used to secure the frame 130 to a circuit board 170 (shown in FIG. 3) with metal sheet portions 150*a* and 150*b* and pre-molded encapsulation layer 165 (shown in FIG. 3) sandwiched between frame 130 and circuit board 170.

Figure 3:
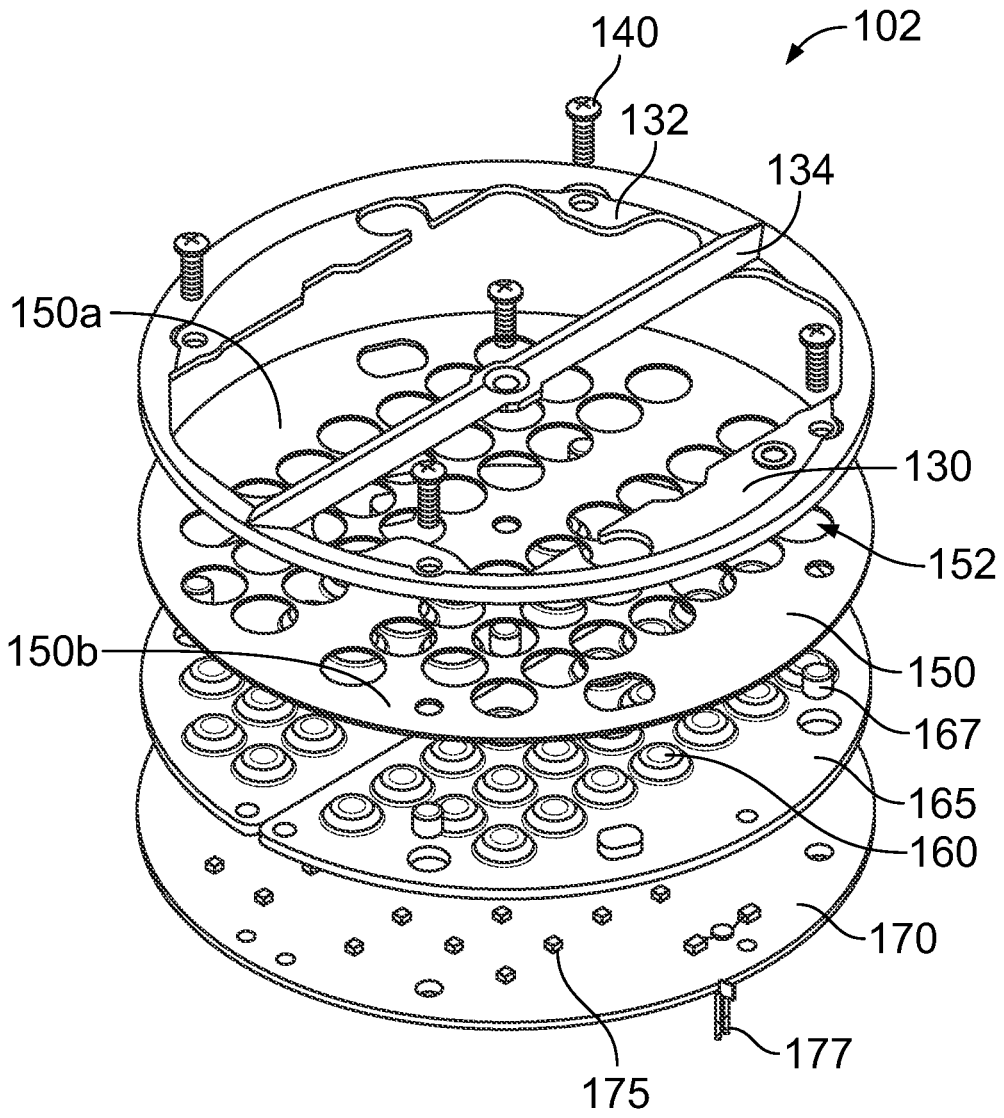
FIG. 3 shows an exploded view of the LED engine 102 shown in FIG. 2.

FIG. 3 shows an exploded view of the LED engine 102 shown in FIG. 2. LED engine 102 includes frame 130 positioned over metal sheet 150, and over pre-molded encapsulation layer 165, and circuit board 170. Metal sheet 150 includes a plurality of apertures 152 through which lenses 160 of pre-molded encapsulation layer 165 extend through. Apertures 152 have a slightly smaller diameter than a diameter of lenses 160 to advantageously hold the lenses 160 in a proper position and maintain a force on the lenses 160 of pre-molded encapsulation layer 165 to prevent delamination of pre-molded encapsulation layer 165 from circuit board 170 Pre-molded encapsulation layer 165 may be comprised of one or more separate sheets positioned adjacent each other. A plurality of LEDs 175 are mounted to circuit board 170 and a plurality of wires 177 extend from circuit board 170 that are used to electrically connect the plurality of LEDs 175 to an LED driver in LED luminaire 100. Fasteners 140, which may be threaded screws, extend through frame flange 132 of frame 130 and are used to secure frame 130 to circuit board 170 with metal sheet 150 and pre-molded encapsulation layer 165 sandwiched between frame 130 and circuit board 170.

Figure 10:
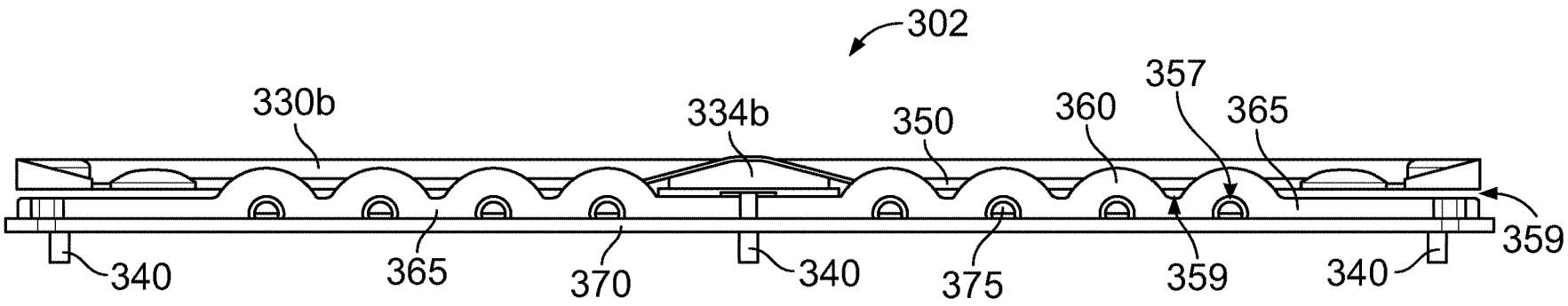
FIG. 10 a side cross-sectional view of the LED engine 302 shown in FIGS. 8 and 9.

Spacers 167 are used to provide an air gap (air gap 359 is shown in FIG. 10) between metal sheet 150 and pre-molded encapsulation layer 165. The spacers 167 may be made of stainless steel or other suitable material, and advantageously provide an air gap of 0.5 mm to 2.0 mm between metal sheet 150 and encapsulation layer 165 to allow for thermal expansion of pre-molded encapsulation layer 165 and lenses 160 as a result of heat emanating from LEDs 175. Pre-molded encapsulation layer 165 is preferably adhered to circuit board 170 using an adhesive, such as RTV sealant 5818 available from Momentive. Lenses 160 on pre-molded encapsulation layer 165 are positioned over LEDs 175 on circuit board 170. The pre-molded encapsulation layer may be made of silicone, such as MS1002 available from DOW, although other moldable materials may also be used. The use of a pre-molded encapsulation layer 165 adhesively attached to circuit board 170 is in compliance with IEC 60069-18 (Equipment Protection by Encapsulation).

The pre-molded encapsulation layer 165 is configured to encapsulate each of the LEDs 175 and LED arrays mounted to circuit board 170 to protect the area proximal to the circuit board from arc and spark, i.e., electrical discharges, generated by the LEDs 175 and LED arrays mounted to circuit board 170. In addition, the use of a pre-molded encapsulation layer 165 avoids bubbles and dirt specks from being captured when using a poured on or cast-on silicone encapsulant. Further, multiple variations of a pre-molded encapsulation layer 165 may be used interchangeably at final assembly of the LED engine 102, and a particular configuration of the pre-molded encapsulation layer 165 may be selected at the time of assembly to provide different optical patterns or other properties as needed for the LED luminaire 100. This interchangeability and use of different configurations of the pre-molded encapsulation layer 165 avoids excess inventories of LED light engines 102 needed for poured on or cast-on encapsulation alternatives, and as such provide for a lower cost than employing directly cast-on silicone encapsulation.

Frame 130 can be made of aluminium, stainless steel, or other suitable metals, as well as plastic or other rigid materials. Frame 130 is secured to circuit board 170 using fasteners 140 with metal sheet 150 and pre-molded encapsulation layer 165 sandwiched between frame 130 and circuit board 170, and therefore serves to prevent detachment of the adhesive between the pre-molded encapsulation layer 165 and circuit board 170 when the assembly is subjected to high temperature accelerated aging and related thermally induced expansion and contraction of the lenses 160 and the pre-molded encapsulation layer 165. The frame 130 and use of spacers 167 are designed in such a way that the expansion/contraction of the lenses 160 and pre-molded encapsulation layer 165 is only partially restrained by metal sheet 150, and allow the pre-molded encapsulation layer 165 and lenses 160 to move (expand/contract) under the frame 1 during expansion/contraction.

The encapsulated LED engine 100, of the present disclosure, can be used in IEC Zone-1 and Zone-2 applications. Specifically, in order to use the encapsulated LED engine 100 in Zone-1 application, the required thickness of the pre-molded encapsulation layer 165 may be greater than or equal to 3 mm. The encapsulated LED engine 102 can also be used in industrial LED luminaires. Further, pre-molded encapsulation layer 165 with lenses 160 provides a desired light distribution pattern without requiring use of any further lenses or reflectors.

The combination of a pre-molded encapsulation layer 165, adhesive, metal sheet 150, frame 130, and spacer2 167 maintains a gas tight seal between the pre-molded encapsulation layer 165 and circuit board 170.

Figure 4:
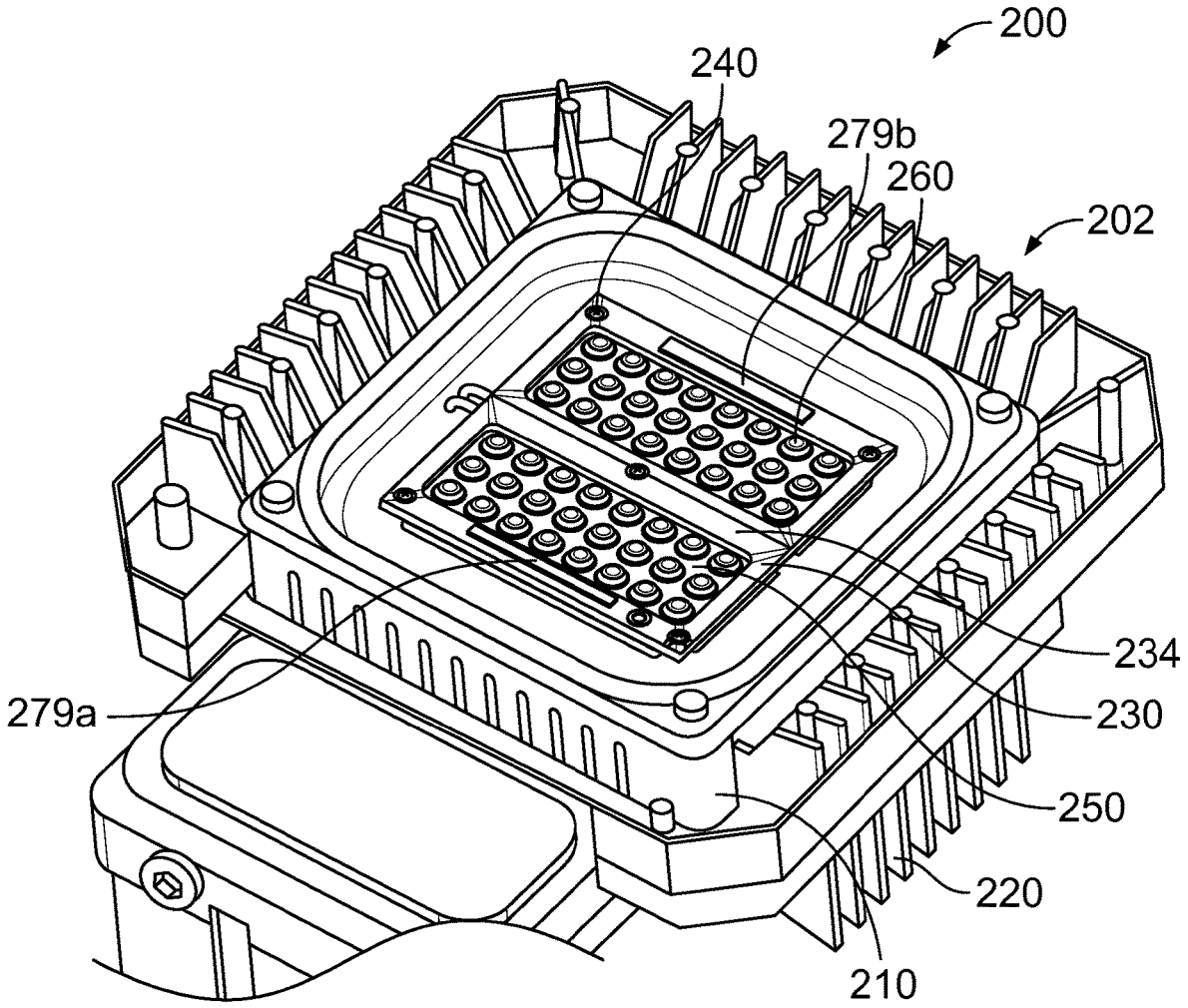
FIG. 4 illustrates a perspective view of LED luminaire 200, in accordance with an embodiment of the present disclosure.
Figure 5:
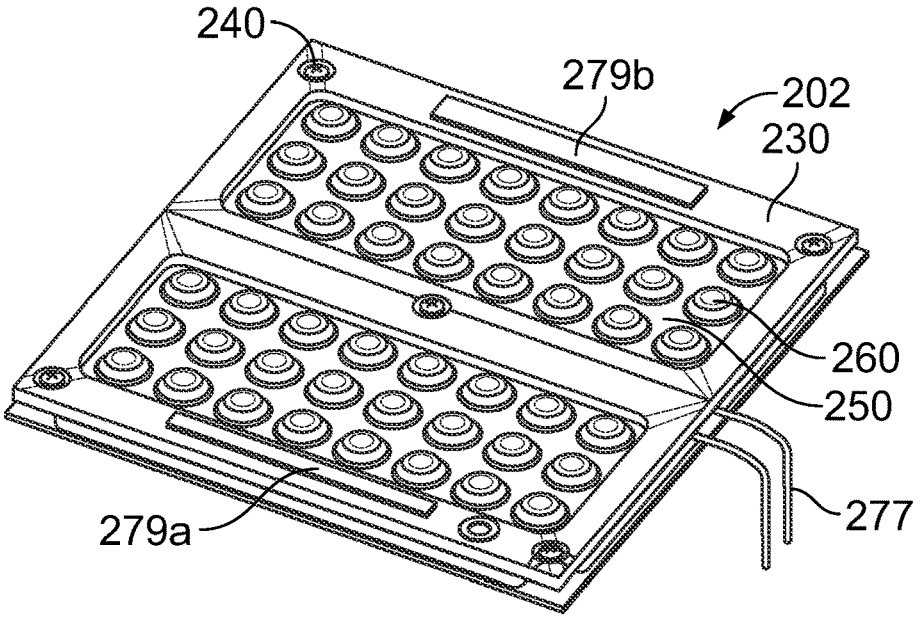
FIG. 5 shows a perspective view of the LED engine 202 of LED luminaire 200 shown in FIG. 4.

FIG. 4 illustrates a perspective view of LED luminaire 200, and FIG. 5 shows a perspective view of LED engine 202 of LED luminaire 200. LED engine 202 is positioned centrally within the LED luminaire 200. A plurality of fins 220 extend from housing 210 of LED luminaire 200. A frame 230 with cross beam 234 is positioned over metal sheet 250 and lenses 260 (shown here as raised bubbles) that extend through apertures 252 of metal sheet 250. Fasteners 240, which may be threaded screws, extend through frame 230 and are used to secure the frame 230 to a circuit board 270 (shown in FIG. 6) with metal sheet 250 and pre-molded encapsulation layer 265 (shown in FIG. 6) sandwiched between frame 230 and circuit board 270.

Figure 6:
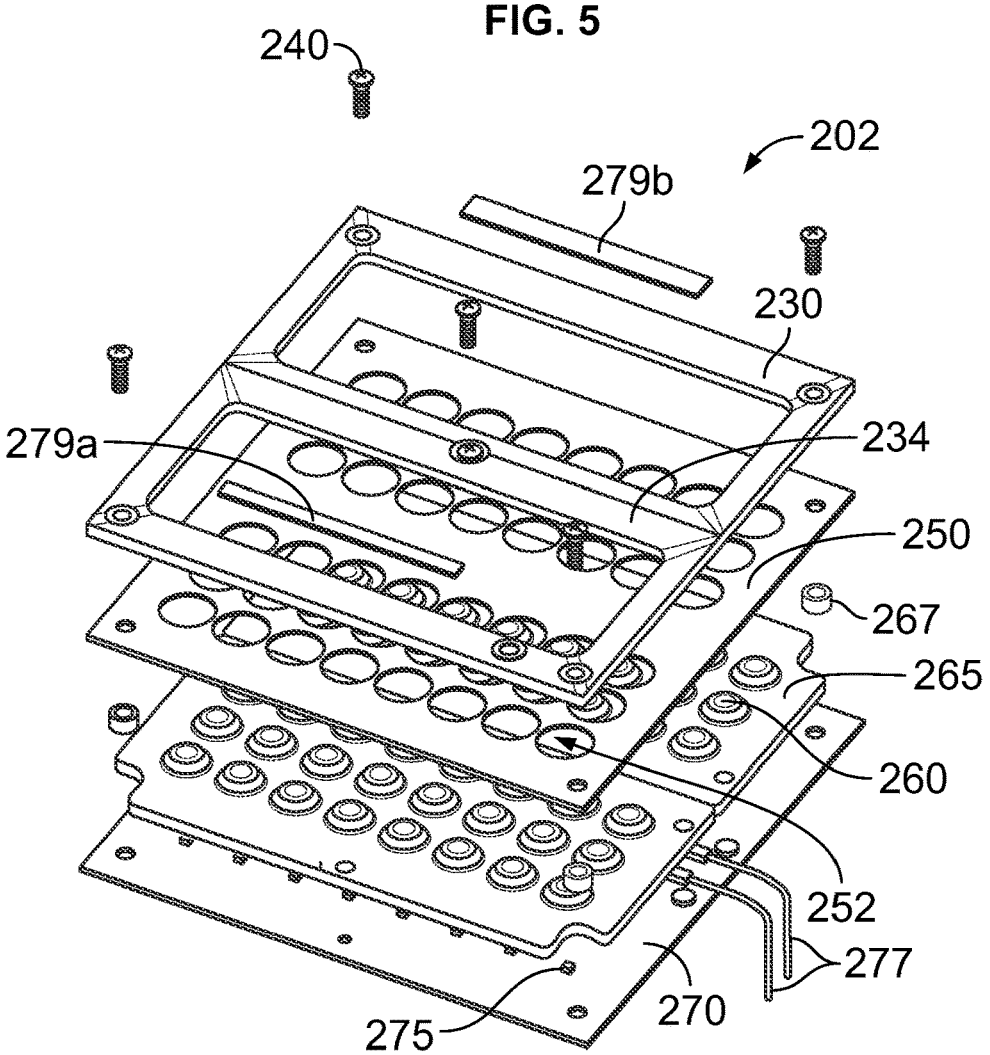
FIG. 6 shows an exploded view of the LED engine 202 shown in FIG. 5.

FIG. 6 shows an exploded view of the LED engine 202 shown in FIG. 5. LED engine 202 includes frame 230 positioned over metal sheet 250, and over pre-molded encapsulation layer 265, and circuit board 270. Metal sheet 250 includes a plurality of apertures 252 through which lenses 260 of pre-molded encapsulation layer 265 extend through. Apertures 252 have a slightly smaller diameter than a diameter of lenses 260 to advantageously hold the lenses 260 in a proper position and maintain a force on the lenses 260 of pre-molded encapsulation layer 265 to prevent delamination of pre-molded encapsulation layer 265 from circuit board 270. Pre-molded encapsulation layer 265 may be comprised of one or more separate sheets positioned adjacent each other. A plurality of LEDs 275 are mounted to circuit board 270 and a plurality of wires 277 extend from circuit board 270 that are used to electrically connect the plurality of LEDs 275 to an LED driver in LED luminaire 200. Fasteners 240, which may be threaded screws, extend through frame 230 and are used to secure frame 230 to circuit board 270 with metal sheet 250 and pre-molded encapsulation layer 265 sandwiched between frame 230 and circuit board 270.

Spacers 267 are used to provide an air gap (air gap 359 is shown in FIG. 10) between metal sheet 250 and pre-molded encapsulation layer 265. The spacers 267 may be made of stainless steel or other suitable material, and advantageously provide an air gap of 0.5 mm to 2.0 mm between metal sheet 250 and encapsulation layer 265 to allow for thermal expansion of pre-molded encapsulation layer 265 and lenses 260 as a result of heat emanating from LEDs 275. Pre-molded encapsulation layer 265 is preferably adhered to circuit board 270 using an adhesive, such as RTV sealant 5818 available from Momentive. Lenses 260 on pre-molded encapsulation layer 265 are positioned over LEDs 275 on circuit board 270. The pre-molded encapsulation layer may be made of silicone, such as MS1002 available from DOW, although other moldable materials may also be used. The use of a pre-molded encapsulation layer 265 adhesively attached to circuit board 270 is in compliance with IEC 60069-18 (Equipment Protection by Encapsulation).

The pre-molded encapsulation layer 265 is configured to encapsulate each of the LEDs 275 and LED arrays mounted to circuit board 270 to protect the area proximal to the circuit board from arc and spark, i.e., electrical discharges, generated by the LEDs 275 and LED arrays mounted to circuit board 270. In addition, the use of a pre-molded encapsulation layer 265 avoids bubbles and dirt specks from being captured when using a poured on or cast-on silicone encapsulant. Further, multiple variations of a pre-molded encapsulation layer 265 may be used interchangeably at final assembly of the LED engine 202, and a particular configuration of the pre-molded encapsulation layer 265 may be selected at the time of assembly to provide different optical patterns or other properties as needed for the LED luminaire 200. This interchangeability and use of different configurations of the pre-molded encapsulation layer 265 avoids excess inventories of LED light engines 202 needed for poured on or cast-on encapsulation alternatives, and as such provide for a lower cost than employing directly cast-on silicone encapsulation.

Frame 230 can be made of aluminium, stainless steel, or other suitable metals, as well as plastic or other rigid materials. Frame 230 is secured to circuit board 270 using fasteners 240 with metal sheet 250 and pre-molded encapsulation layer 265 sandwiched between frame 230 and circuit board 270, and therefore serves to prevent detachment of the adhesive between the pre-molded encapsulation layer 265 and circuit board 270 when the assembly is subjected to high temperature accelerated aging and related thermally induced expansion and contraction of the lenses 260 and the pre-molded encapsulation layer 265. The frame 230 and use of spacers 267 are designed in such a way that the expansion/contraction of the lenses 260 and pre-molded encapsulation layer 265 is only partially restrained by metal sheet 250, and allow the pre-molded encapsulation layer 265 and lenses 260 to move (expand/contract) under the frame 230 during expansion/contraction.

The encapsulated LED engine 200, of the present disclosure, can be used in IEC Zone-1 and Zone-2 applications. Specifically, in order to use the encapsulated LED engine 202 in Zone-1 application, the required thickness of the pre-molded encapsulation layer 265 may be greater than or equal to 3 mm. The encapsulated LED engine 202 can also be used in industrial LED luminaires. Further, pre-molded encapsulation layer 265 with lenses 260 provides a desired light distribution pattern without requiring use of any further lenses or reflectors.

The combination of a pre-molded encapsulation layer 265, adhesive, metal sheet 250, frame 230, and spacers 267 maintains a gas tight seal between the pre-molded encapsulation layer 265 and circuit board 270.

Figure 7:
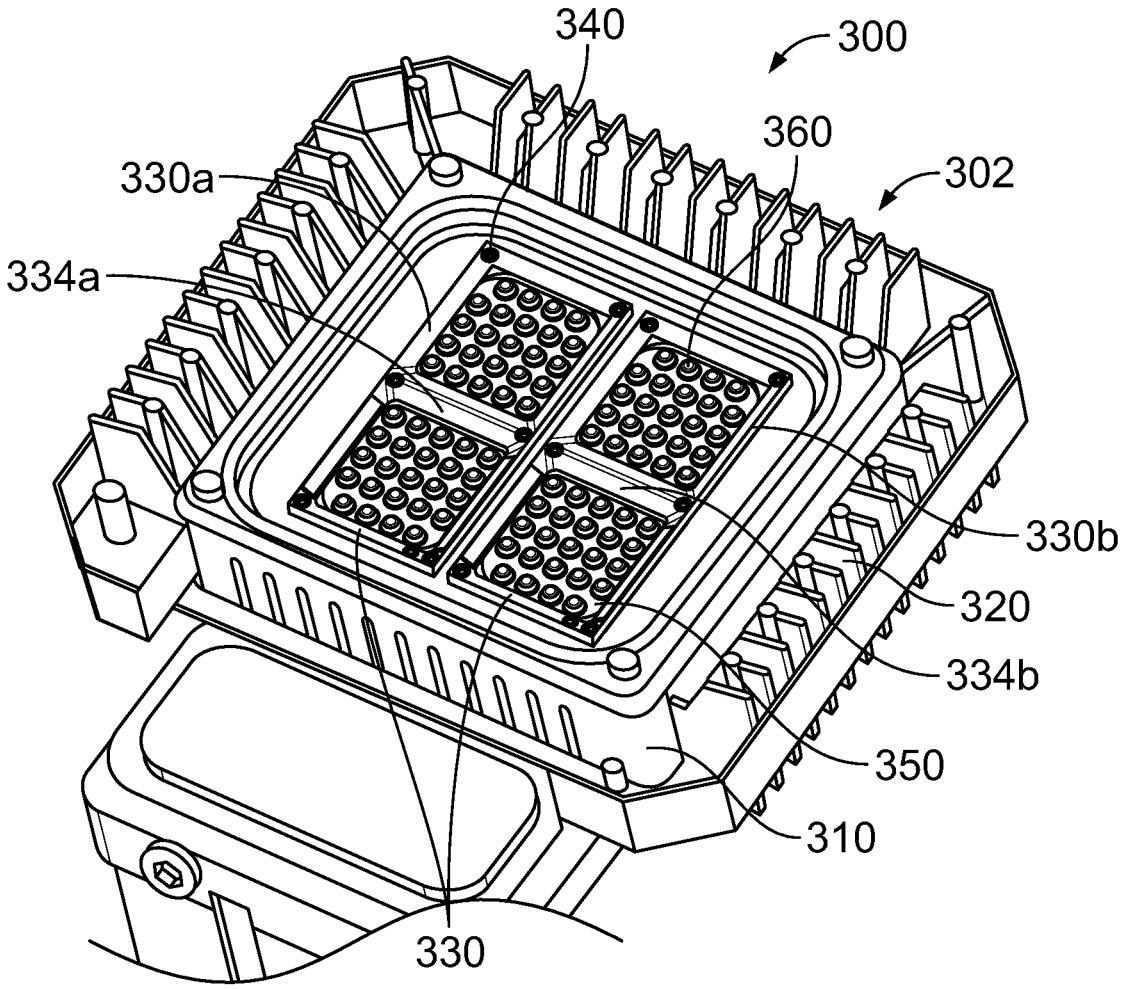
FIG. 7 illustrates a perspective view of LED luminaire 300, in accordance with an embodiment of the present disclosure.
Figure 8:
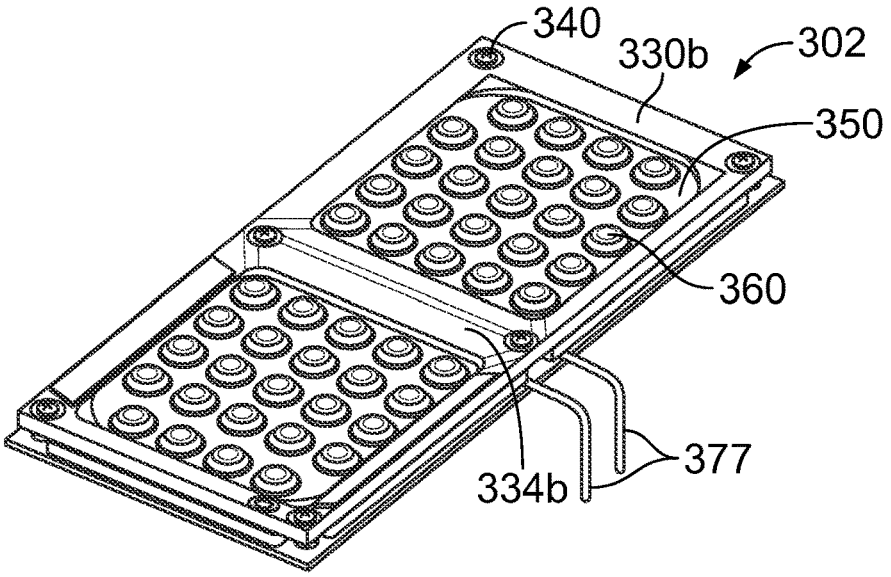
FIG. 8 shows a perspective view of the LED engine 302 of LED luminaire 300 shown in FIG. 7.

FIG. 7 illustrates a perspective view of LED luminaire 300, and FIG. 8 shows a perspective view of LED engine 302 of LED luminaire 300. LED engine 302 is positioned centrally within the LED luminaire 300. A plurality of fins 320 extend from housing 310 of LED luminaire 300. A frame 330 (comprising frame members 334*a* and 334*b*) with cross beams 334*a*, 334*b* is positioned over metal sheet 350 and lenses 360 (shown here as raised bubbles) that extend through apertures 352 of metal sheet 350. Fasteners 340, which may be threaded screws, extend through frame 330 and are used to secure the frame 330 to a circuit board 370 (shown in FIG. 9) with metal sheet 350 and pre-molded encapsulation layer 365 (shown in FIG. 9) sandwiched between frame 330 and circuit board 270. The frame 330 may be comprised a single piece, and may also be comprised of multiple pieces as shown here with frame members 330*a* and 330*b*.

Figure 9:
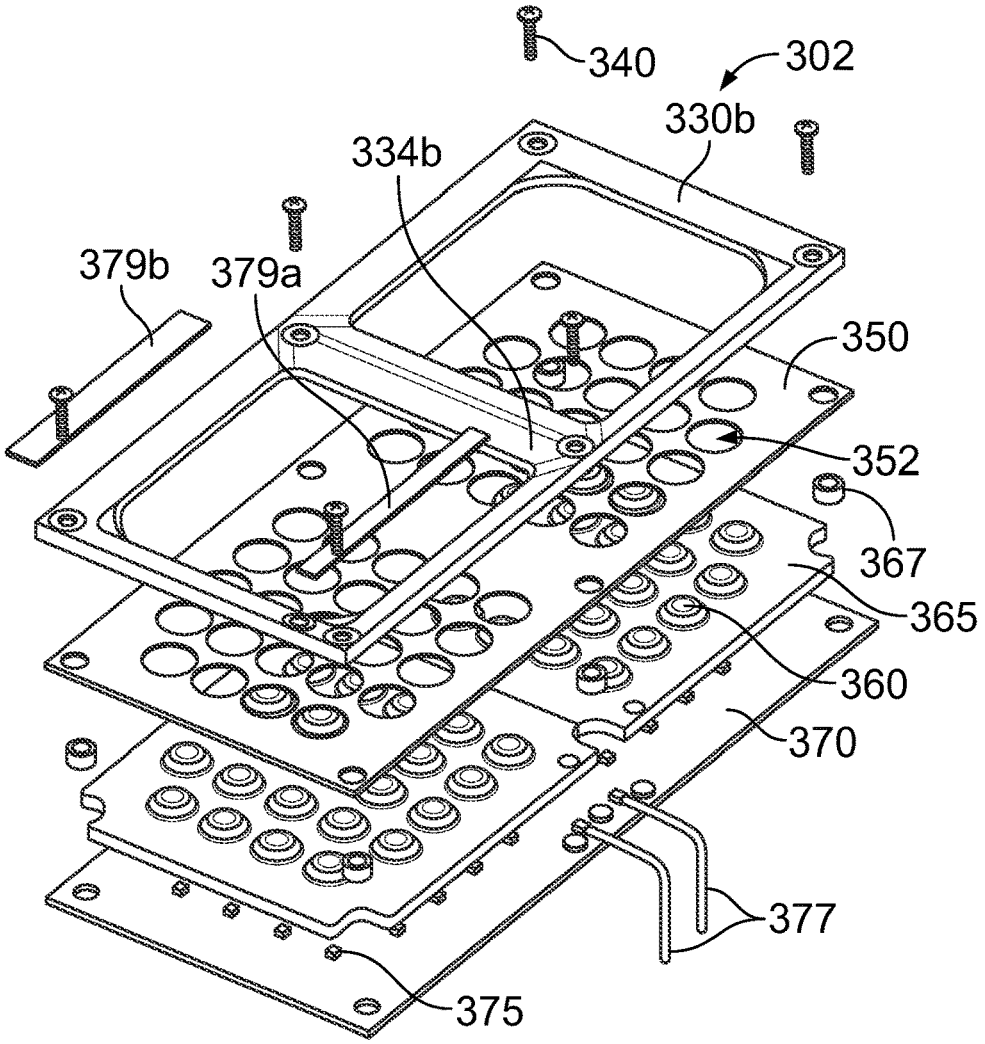
FIG. 9 shows an exploded view of the LED engine 302 shown in FIG. 8.

FIG. 9 shows an exploded view of the LED engine 302 shown in FIG. 8. LED engine 302 includes frame 330 positioned over metal sheet 350, and over pre-molded encapsulation layer 365, and circuit board 370. Metal sheet 350 includes a plurality of apertures 352 through which lenses 360 of pre-molded encapsulation layer 365 extend through. Apertures 352 have a slightly smaller diameter than a diameter of lenses 360 to advantageously hold the lenses 360 in a proper position and maintain a force on the lenses 360 of pre-molded encapsulation layer 365 to prevent delamination of pre-molded encapsulation layer 365 from circuit board 170. Pre-molded encapsulation layer 365 may be comprised of one or more separate sheets positioned adjacent each other. A plurality of LEDs 375 are mounted to circuit board 370 and a plurality of wires 377 extend from circuit board 370 that are used to electrically connect the plurality of LEDs 375 to an LED driver in LED luminaire 300. Fasteners 340, which may be threaded screws, extend through frame 330 and are used to secure frame 330 to circuit board 370 with metal sheet 350 and pre-molded encapsulation layer 365 sandwiched between frame 330 and circuit board 370.

Spacers 367 are used to provide an air gap (air gap 359 is shown in FIG. 10) between metal sheet 350 and pre-molded encapsulation layer 365. The spacers 367 may be made of stainless steel or other suitable material, and advantageously provide an air gap of 0.5 mm to 2.0 mm between metal sheet 350 and encapsulation layer 365 to allow for thermal expansion of pre-molded encapsulation layer 365 and lenses 360 as a result of heat emanating from LEDs 375. Pre-molded encapsulation layer 365 is preferably adhered to circuit board 370 using an adhesive, such as RTV sealant 5818 available from Momentive. Lenses 360 on pre-molded encapsulation layer 365 are positioned over LEDs 375 on circuit board 370. The pre-molded encapsulation layer may be made of silicone, such as MS1002 available from DOW, although other moldable materials may also be used. The use of a pre-molded encapsulation layer 365 adhesively attached to circuit board 370 is in compliance with IEC 60069-18 (Equipment Protection by Encapsulation).

The pre-molded encapsulation layer 365 is configured to encapsulate each of the LEDs 375 and LED arrays mounted to circuit board 370 to protect the area proximal to the circuit board from arc and spark, i.e., electrical discharges, generated by the LEDs 375 and LED arrays mounted to circuit board 370. In addition, the use of a pre-molded encapsulation layer 365 avoids bubbles and dirt specks from being captured when using a poured on or cast-on silicone encapsulant. Further, multiple variations of a pre-molded encapsulation layer 365 may be used interchangeably at final assembly of the LED engine 302, and a particular configuration of the pre-molded encapsulation layer 365 may be selected at the time of assembly to provide different optical patterns or other properties as needed for the LED luminaire 300. This interchangeability and use of different configurations of the pre-molded encapsulation layer 365 avoids excess inventories of LED light engines 302 needed for poured on or cast-on encapsulation alternatives, and as such provide for a lower cost than employing directly cast-on silicone encapsulation.

Frame 330 can be made of aluminium, stainless steel, or other suitable metals, as well as plastic or other rigid materials. Frame 330 is secured to circuit board 370 using fasteners 340 with metal sheet 350 and pre-molded encapsulation layer 365 sandwiched between frame 330 and circuit board 370, and therefore serves to prevent detachment of the adhesive between the pre-molded encapsulation layer 365 and circuit board 370 when the assembly is subjected to high temperature accelerated aging and related thermally induced expansion and contraction of the lenses 360 and the pre-molded encapsulation layer 365. The frame 330 and use of spacers 367 are designed in such a way that the expansion/contraction of the lenses 360 and pre-molded encapsulation layer 365 is only partially restrained by metal sheet 350, and allow the pre-molded encapsulation layer 365 and lenses 360 to move (expand/contract) under the frame 330 during expansion/contraction.

The encapsulated LED engine 300, of the present disclosure, can be used in IEC Zone-1 and Zone-2 applications. Specifically, in order to use the encapsulated LED engine 302 in Zone-1 application, the required thickness of the pre-molded encapsulation layer 365 may be greater than or equal to 3 mm. The encapsulated LED engine 302 can also be used in industrial LED luminaires. Further, pre-molded encapsulation layer 365 with lenses 360 provides a desired light distribution pattern without requiring use of any further lenses or reflectors.

The combination of a pre-molded encapsulation layer 365, adhesive, metal sheet 350, frame 330, and spacers 337 maintains a gas tight seal between the pre-molded encapsulation layer 365 and circuit board 370.

The frame used in the LED luminaire may have an outer periphery that is round (see frame 130), square (see frame 330), or rectangular (see frame 230), and other geometries such as oval, hexagonal, etc. may also be used for the frame.

FIG. 10 a side cross-sectional view of the LED engine 302 shown in FIGS. 8 and 9. Frame member **330*b* is positioned over metal sheet 350, pre-molded encapsulation layer 365, and circuit board 370. Air gap 359 is positioned between metal sheet 350 and pre-molded encapsulation layer 365. Lenses 360 of pre-molded encapsulation layer 365 partially extend through apertures 352 (see FIG. 9) of metal sheet 350. In addition, an air gap 357 is positioned between an outer surface of LEDs 375 and inner surfaces of lenses 360 to prevent undesired direct contact between LEDs 375 and lenses 360**.

LED engines 102, 202, and 302 (hereinafter collectively referred to as "LED engines") provide significant advantages. Main features of the LED engines include the use of a pre-molded encapsulation layer containing molded lenses to provide a method and construction for Ex (explosion proof) mb (molded encapsulation) protection for LED engines having various light output capacities and shapes and sizes. Advantageously, the LED engines include a pre-molded encapsulation layer with pre-molded lenses (providing desired optics) that is adhered to the circuit board to provide an EX mb joint surrounding the LEDs on the LED engines. A metal sheet is then positioned over the pre-molded encapsulation layer which helps the pre-molded encapsulation layer and lenses thereon to successfully withstand high temperature conditions that may arise in an actual field application or during certification testing. The entire assembly is held together with a rigid frame secured to the circuit board with the pre-molded encapsulation layer and metal sheet sandwiched between the rigid frame and the circuit board.

In existing encapsulation techniques (e.g. the use of potting and poured or cast on encapsulation) used for providing Ex mb protection, there is a persistent issue of the encapsulant touching the LEDs and damaging them where the chemical interaction between the LEDs and encapsulant can damage the LEDs or reduce their performance. In addition, with poured or cast on encapsulant, the direct encapsulation method may include the formation of air bubbles which presents a threat and risk for the Ex mb ratings. Additionally, when a direct encapsulation (or potting) method is used with low power LEDs or flat dome LEDs, because of a change in refractive index of the encapsulant material, the inherent CCT (correlated color temperature shift) of the light emitted by the LEDs may be changed drastically which is not controllable and is a huge set back when it comes to actual implementation of the solution.

The design of the LED engines provides design methodology for Ex mb LED engines needed for high temperature applications (>1 OOdegC), and the use of a pre-molded encapsulation layer with pre-molded lenses avoids the chances of undesirable bubble formation in the encapsulation layer. In addition, the design of the LED engines sustains differential contraction and expansion of materials involved in the design, including aluminum, silicone, copper, and iron, zinc, and steel. With the use of a metal sheet positioned over the pre-molded encapsulation layer and pre-molded lenses therein, which may be made of silicone, the LED engine design ensures that the pre-molded encapsulation layer remains adhered to the circuit board in severe temperature conditions, thus ensuring a reliable and safe design.

The use of a metal sheet prevents delamination of the pre-molded encapsulation layer from the circuit board when stressed under extreme temperature conditions, and also helps in reducing light transmission losses. In addition, the metal sheet and rigid frame also prevent delamination caused by expansion and contraction resulting from changes in temperatures, as well as delamination that can occur due to gravitational effects, as in actual application the LED engines are mounted faced downward in most applications and in certification aging tests the LED engines are mounted facing downwards.

Furthermore, the design of the LED engines provides that a gap is maintained between the pre-molded encapsulation layer and the metal sheet, which may provide of a gap in the range of 0.05 mm to 2 mm. The use of such a gap helps in maintaining a clearance between the pre-molded encapsulation layer and the metal sheet, and thus avoids excess pressure on the pre-molded encapsulation layer and lenses there provided therein when they expand during a thermal cycle. The use of a gap between the pre-molded encapsulation layer and the metal sheet therefore also avoids the generation of any cracks the pre-molded lenses of the pre-molded encapsulation layer when they expand during a thermal cycle.

The design of the LED engines using a pre-molded encapsulation layer with pre-molded lenses with a metal sheet positioned thereover sandwiched between a rigid frame and a circuit board provides a number of significant advantages over existing LED engines, including providing a low cost Ex mb solution, a bubble free encapsulation design concept using a pre-molded encapsulation layer with pre-molded lenses (providing desired optics), a design suitable for extreme temperature conditions, provides pre-molded lenses on a pre-molded encapsulation layer that provide for desired beam patterns and light output, and eliminates issues of CCT (correlated color temperature shift).

Technical Advancements

The present disclosure described herein above has a number of technical advantages including, but not limited to, the realization of an encapsulated LED engine that:

- is cost effective;
- has reduced surface temperature;
- has a simple configuration;
- has improved life;
- is not prone to early delamination due to frequent exposure to thermal shocks;
- eliminates the requirement of secondary optics;
- is modular;
- better utilizes circuit board space;
- eliminates formation of air bubbles;
- is light in weight; and
- does not affect a beam pattern of the LED arrays.

The foregoing disclosure has been described with reference to the accompanying embodiments which do not limit the scope and ambit of the disclosure. The description provided is purely by way of example and illustration.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The foregoing description of the specific embodiments so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the disclosure to achieve one or more of the desired objects or results.

Any discussion of documents, acts, materials, devices, articles or the like that has been included in this specification is solely for the purpose of providing a context for the disclosure. It is not to be taken as an admission that any or all of these matters form a part of the prior art base or were common general knowledge in the field relevant to the disclosure as it existed anywhere before the priority date of this application.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation.

We claim:

1. An encapsulated LED engine comprising:

a circuit board;

one or more LED arrays, each of the one or more LED arrays mounted on the circuit board;

a pre-molded encapsulation layer positioned over the circuit board;

a frame positioned over the pre-molded encapsulation layer and secured to the circuit board;

a metal sheet separate from the frame, the metal sheet positioned between the pre-molded encapsulation layer and the frame;

wherein the pre-molded encapsulation layer includes a plurality of lenses positioned over a plurality of LEDs on each of the one or more LED arrays; and wherein the metal sheet includes a plurality of apertures through which the plurality of lenses on the pre-molded encapsulation layer extend through.

2. The encapsulated LED engine as claimed in claim 1, wherein one or more spacers are positioned between the metal sheet and the circuit board.

3. The encapsulated LED engine as claimed in claim 2, wherein the one or more spacers provide a gap of 0.05 mm to 2 mm between the metal sheet and the pre-molded encapsulation layer.

4. The encapsulated LED engine as claimed in claim 2, wherein the one or more spacers are comprised of stainless steel.

5. The encapsulated LED engine as claimed in claim 1, wherein the frame is secured to the circuit board using a plurality of fasteners extending through the frame, extending through the metal sheet, and into the circuit board.

6. The encapsulated LED engine as claimed in claim 1, wherein the metal sheet is comprised of aluminum, steel, iron, or zinc.

7. The encapsulated LED engine as claimed in claim 1, wherein the plurality of lenses on the pre-molded encapsulation layer extend through one or more openings in the frame.

8. The encapsulated LED engine as claimed in claim 1, wherein a diameter of the apertures in the metal sheet have a diameter that is less than a diameter of the lenses that extend through the apertures.

9. The encapsulated LED engine of claim 1, wherein an outer periphery of the frame is one of round, square, or rectangular.

10. The encapsulated LED engine of claim 1, where the LED engine is suitable for use in a Zone-1 environment.

11. The encapsulated LED engine of claim 1, wherein there is an air gap between an inner surface of each of the lenses on the pre-molded encapsulation layer and an outer surface of each of the corresponding LEDs that each of the lenses are positioned over.

12. An encapsulated LED engine comprising:

a circuit board;

one or more LED arrays, each of the one or more LED arrays mounted on the circuit board;

a pre-molded encapsulation layer positioned over the circuit board;

a frame positioned over the pre-molded encapsulation layer and secured to the circuit board;

a metal sheet separate from the frame, the metal sheet positioned between the pre-molded encapsulation layer and the frame;

wherein the pre-molded encapsulation layer includes a plurality of lenses positioned over a plurality of LEDs on each of the one or more LED arrays;

wherein the metal sheet includes a plurality of apertures through which the plurality of lenses on the pre-molded encapsulation layer extend through;

wherein the frame includes a first opening and a second opening through which the plurality of lenses extend; and wherein a cross member is positioned on the frame that extends between the first opening and the second opening.

13. A method of forming an encapsulated LED engine including:

providing a circuit board, one or more LED arrays, each of the one or more LED arrays mounted on the circuit board, a pre-molded encapsulation layer positionable over the circuit board, a frame positionable over the one or more LED arrays and securable to the circuit board, a metal sheet that is separate from the frame, the metal sheet positionable between the pre-molded encapsulation layer and the frame, wherein the pre-molded encapsulation layer includes a plurality of lenses positionable over a plurality of LEDs on each of the one or more LED arrays, and wherein the metal sheet includes a plurality of apertures through which the plurality of lenses on the pre-molded encapsulation layer are extendable through;

positioning the metal sheet over the pre-molded encapsulation layer such that the lenses extend at least partially through the apertures on the metal sheet; and securing the frame to the circuit board over the metal sheet and the pre-molded encapsulation layer.

14. The method of claim 13, further including securing the frame to the circuit board using a plurality of fasteners that extend through the frame and extend through the metal sheet.

15. The method of claim 13, further including positioning one or more spacers between the metal sheet and the pre-molded encapsulation layer.

16. The method of claim 15, wherein the one or more spacers provide a gap of 0.05 mm to 2 mm between the metal sheet and the pre-molded encapsulation layer.

17. The method of claim 13, wherein the plurality of lenses on the pre-molded encapsulation layer extend through one or more openings in the frame.

18. The method of claim 13, where the LED engine is suitable for use in a Zone-1 environment.

19. The method of claim 13, wherein a diameter of the apertures in the metal sheet have a diameter that is less than a diameter of the lenses that extend through the apertures.

20. The method of claim 13, wherein there is an air gap between an inner surface of each of the lenses on the pre-molded encapsulation layer and an outer surface of each of the corresponding LEDs that each of the lenses are positioned over.

* * * * *